US006877875B2

(12) United States Patent
Yu et al.

(10) Patent No.: US 6,877,875 B2
(45) Date of Patent: Apr. 12, 2005

(54) CANTED HEAD-MOUNTED LIGHT

(75) Inventors: Sun Yu, Berkley, MI (US); Andrew Tiefel, South Lyon, MI (US); David Perrin, Troy, MI (US)

(73) Assignee: Zen Design Group, LTD, Berkley, MI (US)

( * ) Notice: Subject to any disclaimer, the term of this patent is extended or adjusted under 35 U.S.C. 154(b) by 56 days.

(21) Appl. No.: 10/288,903

(22) Filed: Nov. 6, 2002

(65) Prior Publication Data

US 2004/0085756 A1 May 6, 2004

(51) Int. Cl.[7] ..... F21V 21/084

(52) U.S. Cl. ..... 362/105; 362/184; 362/191; 362/245; 362/427

(58) Field of Search ..... 362/35, 103, 105, 362/106, 108, 157, 184, 190, 191, 197, 199, 202, 205, 227, 235, 236, 241, 244, 245, 247, 249–251, 362, 372, 382, 418, 427, 430

(56) References Cited

U.S. PATENT DOCUMENTS

| | | | | | |
|---|---|---|---|---|---|
| 581,129 | A | * | 4/1897 | Nevius | 362/105 |
| 1,505,654 | A | * | 8/1924 | MacBeth | 362/282 |
| 2,234,995 | A | * | 3/1941 | Waechter | 362/105 |
| 3,882,490 | A | * | 5/1975 | Tashiro et al. | 340/815.75 |
| 3,906,216 | A | * | 9/1975 | Eriksson | 362/105 |
| 4,211,955 | A | * | 7/1980 | Ray | 315/53 |
| 4,797,793 | A | * | 1/1989 | Fields | 362/105 |
| 5,043,854 | A | * | 8/1991 | Gammache | 362/197 |
| 5,058,900 | A | * | 10/1991 | Denen | 473/570 |
| 6,168,288 | B1 | * | 1/2001 | St. Claire | 362/184 |
| 6,200,001 | B1 | * | 3/2001 | Tin Shun Victor | 362/226 |
| 6,283,610 | B1 | * | 9/2001 | Alajajian | 362/199 |
| 6,485,160 | B1 | * | 11/2002 | Sommers et al. | 362/184 |
| 6,517,215 | B2 | * | 2/2003 | Mele | 362/203 |
| 6,578,994 | B1 | * | 6/2003 | Beyerlein | 362/490 |

* cited by examiner

*Primary Examiner*—John Anthony Ward
*Assistant Examiner*—Ismael Negron
(74) *Attorney, Agent, or Firm*—Gifford, Krass, Groh, Sprinkle, Anderson & Citkowski, P.C.

(57) ABSTRACT

A headlamp includes a base having a front face defining a first imaginary plane along the front face and a first imaginary line orthogonal to the first plane. A light assembly is rotatably secured about the front face to the base. The light assembly includes a bezel having a rear surface defining a second imaginary plane along the rear surface and a second imaginary line orthogonal to the second plane so that the intersection of the first line and the second line defines a rotation angle that varies with the rotation of the light assembly relative to the base, thereby changing the attitude of the headlamp light assembly.

11 Claims, 4 Drawing Sheets

CANTED HEAD-MOUNTED LIGHT

FIELD OF THE INVENTION

The present invention generally relates to headlamps and, more particularly, to headlamps having a movable mount for attitude adjustment of a light beam emanating therefrom.

BACKGROUND OF THE INVENTION

Headlamps, whether attached directly to the head of a user or integrated into protective headgear, are useful operating under low ambient light conditions. This is especially true during prolonged activities that require unfettered use of the hands of a headlamp wearer. Additionally, depending on the activities of a wearer, it is often advantageous to be able to adjust the attitude of the headlamp to selectively light an area about the wearer. A wearer might include a motorcyclist, a bicyclist, a firefighter, a miner, a construction worker, a hiker, a farm worker, a hunter or a naturalist.

Prior art attempts to provide an adjustable attitude headlamp have resorted to a diametric pivot joint to adjust the angle of the light source relative to the headgear and/or the head of the wearer. A diametric pivot represents the weakest portion of the headlamp construction if exposed. Alternatively, a cumbersome support housing is built around the pivot to support and encompass the same thereby adding to the profile and weight of the lamp. Thus, there exists a need for a more rugged attitude adjustable headlamp.

SUMMARY OF THE INVENTION

A headlamp includes a hollow base having a first surface adapted to bear against a user's forehead and defining a first imaginary plane, a first imaginary line normal to the first plane, and a front face inclined downward relative to said first surface by a first angle. A light assembly is rotatably secured to the base. The light assembly includes a bezel having a rear surface rotatably supported relative to the front face of the base and a front surface inclined relative to said first surface by a second angle. The light assembly also includes a battery case attached to the bezel to create an enclosed volume therebetween. A battery and light source are located within the enclosed volume. A switch is provided to selectively form an electrical circuit between the light source and the battery. Rotation of the bezel rotates the light beam projected by the light assembly between a first direction in which the beam is parallel to the normal line and a second direction in which the beam is directed downwardly relative to the normal line by the first angle plus the second angle.

DETAILED DESCRIPTION OF THE INVENTION

The present invention has utility as lamp mountable to the head of a wearer or incorporated into headgear. The present invention provides a rugged and compact headlamp where the lighting assembly cants relative to a static base. The front face of a headlamp base and the rear surface of a bezel incorporated into the light assembly are complementary bevel cut features such that rotation of the bevel cut rear surface of the bezel relative to the base changes the attitude of the light assembly. The present invention details a novel canted headlamp and process for canting a light assembly relative to a static base to adjust light projection attitude.

Figure 1A:
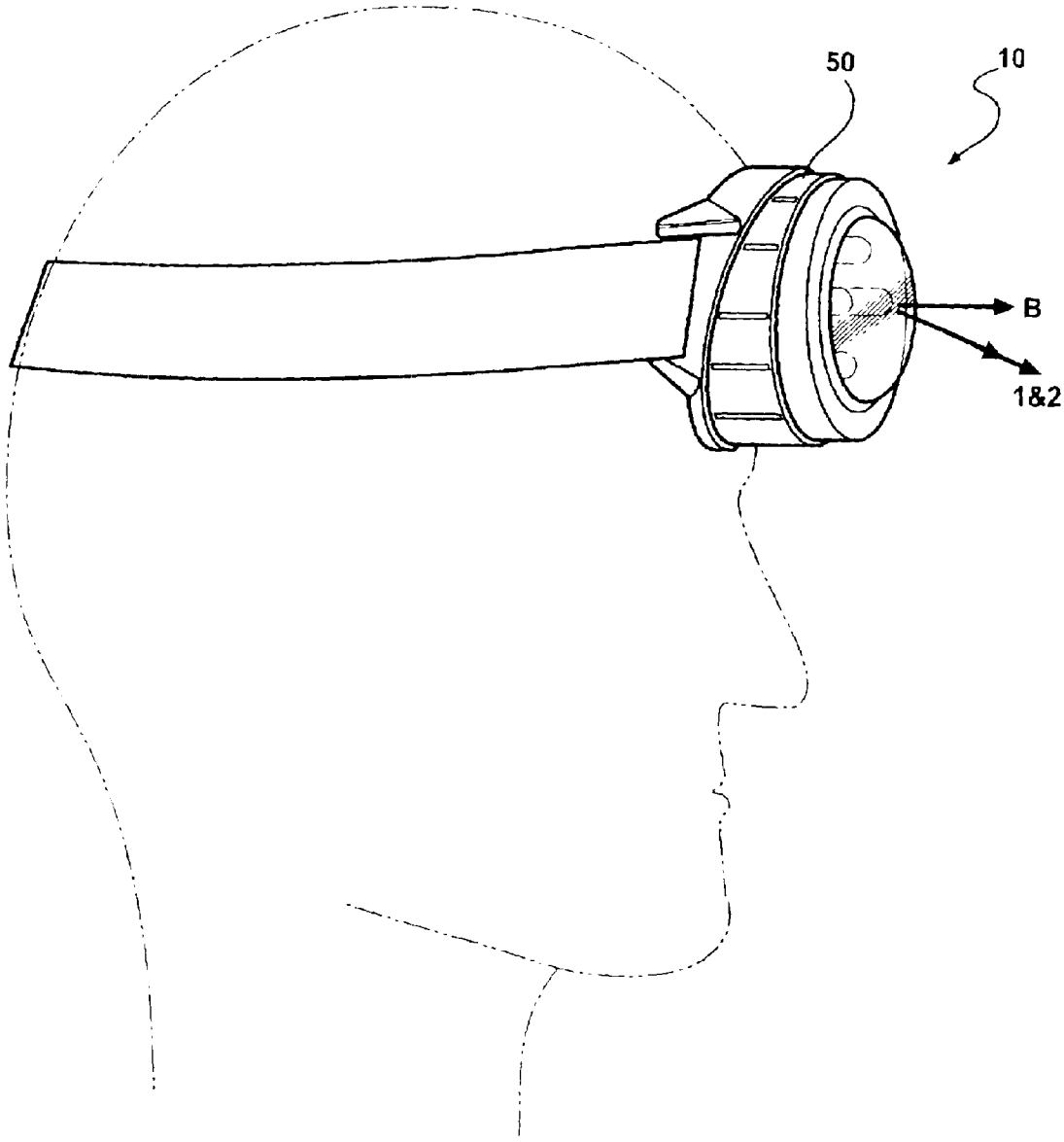
FIG. 1A is a perspective view of an inventive headlamp configured to have a 180° canting angle between the light assembly and base.
Figure 1B:
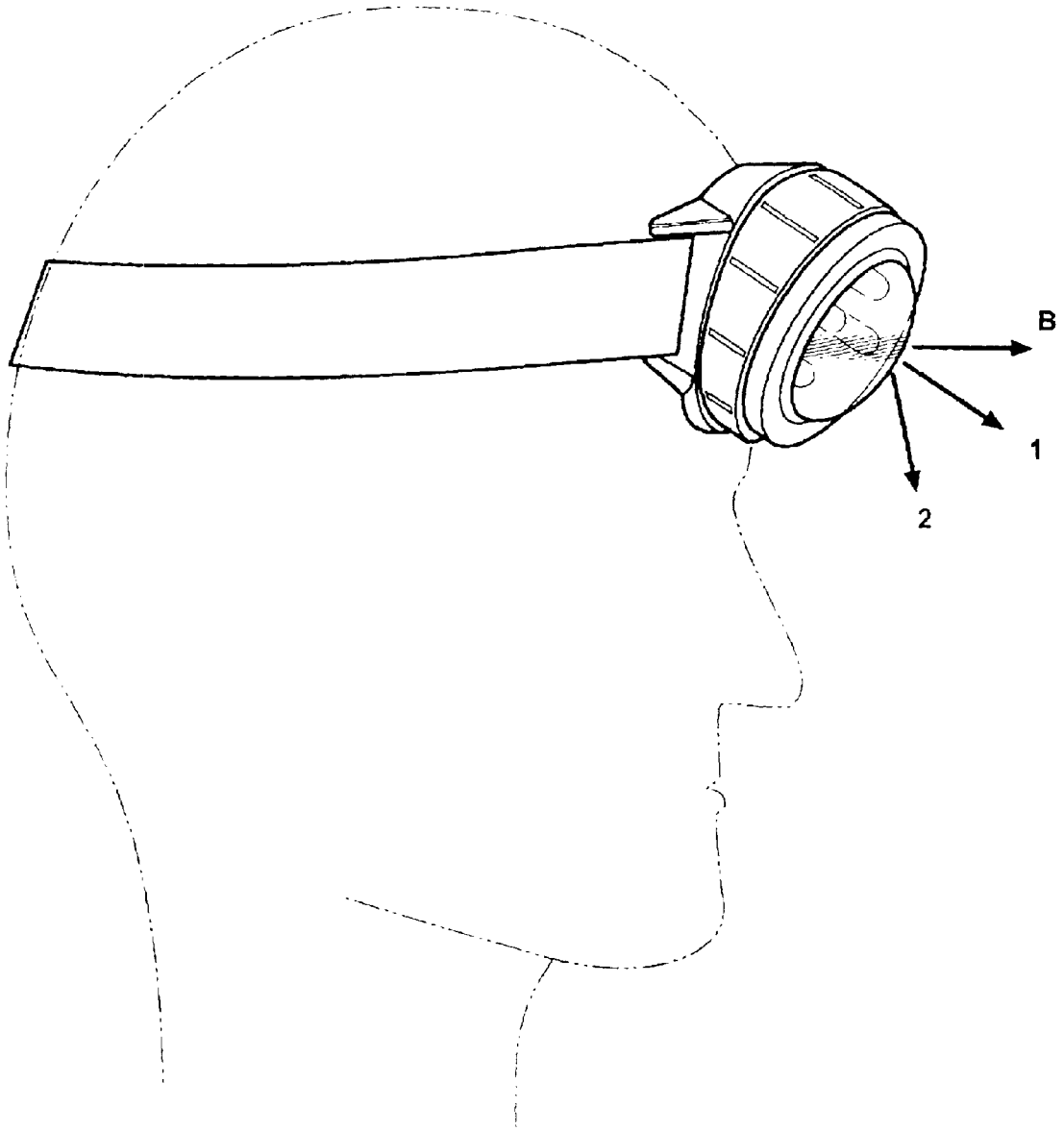
FIG. 1B is a perspective view of the headlamp depicted in FIG. 1A configured to have a canting angle of about 150° between the light assembly canted and the base.
Figure 2:
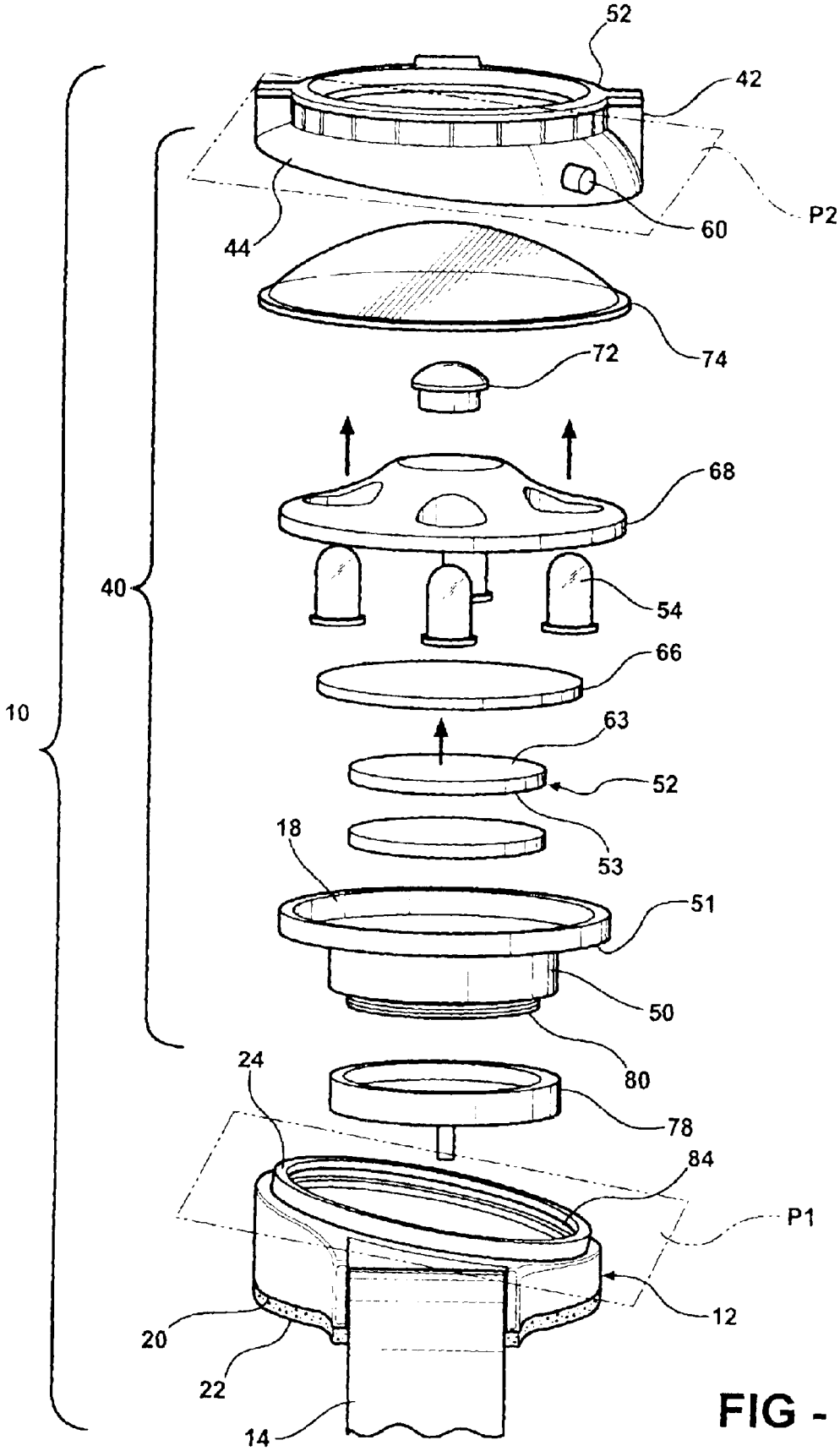
FIG. 2 is an exploded view of the inventive embodiment depicted in FIG. 1A.
Figure 3:
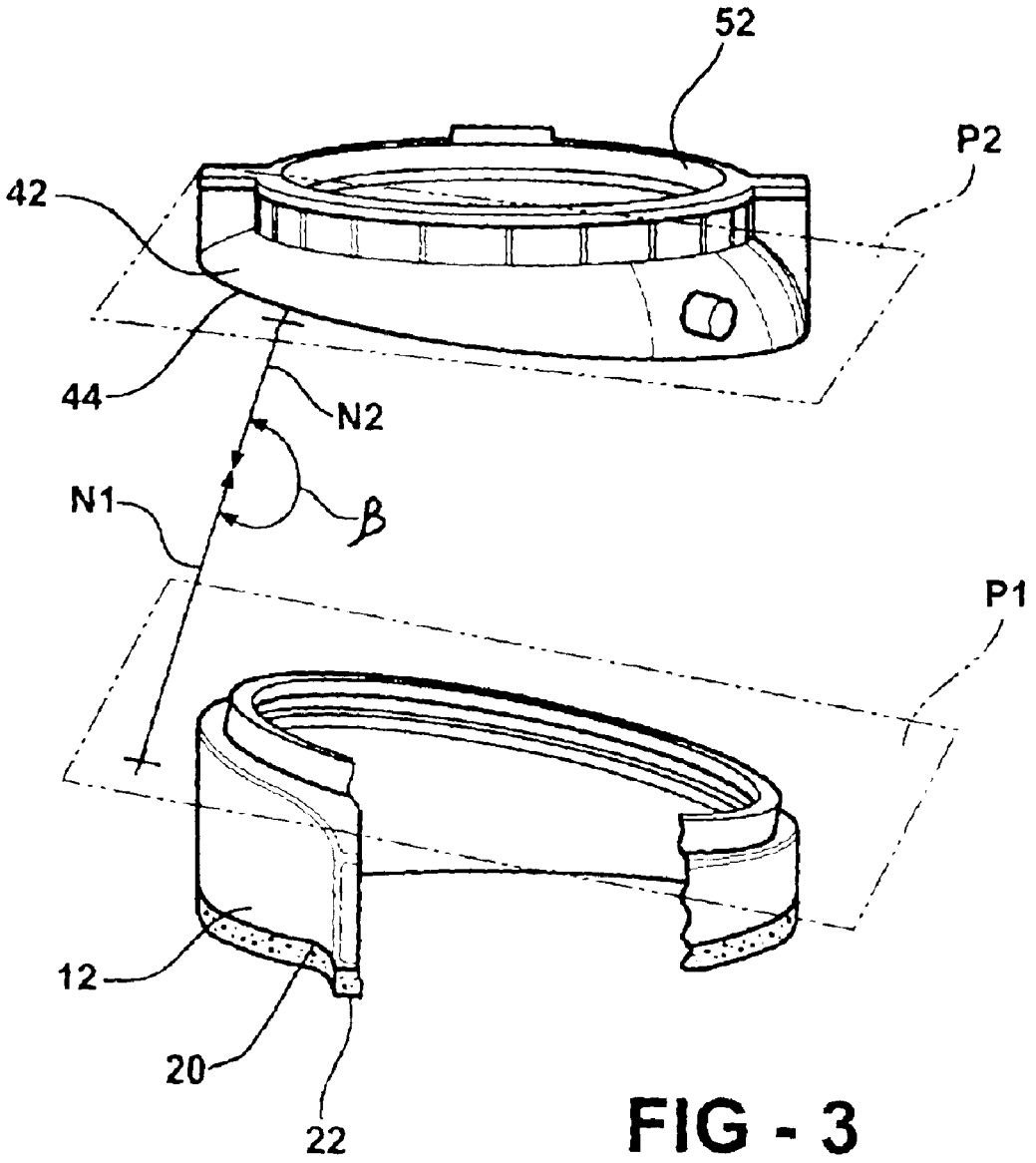
FIG. 3 is a perspective exploded partial cutaway view depicting the various planes and lines that define a canting angle in the inventive embodiment depicted in FIG. 1A.

Referring now to FIGS. 1–3, an inventive headlamp is shown generally at 10. A base 12 is adapted to secure to the head of a wearer by way of a strap 14. The base having conventional strap engaging fixtures such as posts adapted to receive a spring-loaded hinge pin (not shown) affixed to the strap 14. In the preferred embodiment, the base 12 is hollow and capable of receiving some other portion of the inventive headlamp therein. While the present invention is detailed with respect to a headlamp that is directly mounted to the head of a wearer by way of a headband, it is appreciated that a canted headlamp as detailed herein is readily incorporated into a helmet or other headgear. The base 12 has a basal face 20 adapted to contact the head of a wearer or engage a helmet or other headgear. Preferably, a skin compatible foam material 22 is intermediate between the basal face 20 and the skin of a wearer in those embodiments of the present invention, such as those depicted in FIGS. 1–3, where the headlamp is secured directly to the head of a wearer. As shown in FIG. 3, the base 12 has a front face 24 that defines a first plane P1 angled relative to the basal face 20. A basal face is defined by a plane that contains the maximal number of points on the basal face 20. An angle $\alpha$ is defined as the deviation of the front face angle relative to a normal line A to the basal face 20. The front face 24 defines a first plane P1. A normal line N1 to the plane P1 extends therefrom.

A light assembly shown generally at 40 in FIG. 2 rotates relative to the front face 24 of the base 12 such that the light assembly cants with rotation relative to the base 12. The light assembly has a bezel 42 that has a rear surface 44. The rear surface 44 defines a second plane P2 that has a normal line N2 thereto as shown in FIG. 3. The intersection of normal line N1 to the first plane P1 with the normal line N2 to the second plane P2 defines a canting angle $\beta$. The canting angle $\beta$ being 180° where the front surface 52 of the bezel 42 is substantially parallel to the basal face 20 of the base 12. Rotation of the bezel 42 relative to the base 12 varies the canting angle $\beta$ away from 180°. Typically, the canting angle varies between 130° and 230°. Preferably, the canting angle is between 165° and 195°. In other words, rotation of the bezel 42 relative to the base 12 rotates the beam of light projected from a direction parallel to the normal to the plane of the element 20 to a downward direction inclined relative to that normal line by the angle between element 20 and plane P1 plus the angle between plane P2 and the surface 52.

The light assembly 40 has a battery case 50 attached to the bezel 42. The battery case preferably having a circumferential flange 51 that is adapted to rotationally seat in contact with the front face 24. An enclosed volume 18 is defined between the bezel 42 and the battery case 50. A battery 52 and at least a portion of a light source 54 are located within the volume 18. In a preferred embodiment, the light source 54 is a light emitting diode (LED). More preferably, the light source 54 is a plurality of light emitting diodes. It is appreciated that a light emitting diode operative herein has an emission perceptible to the human eye in a variety of colors illustratively including red, orange, yellow, green, blue, and white.

A battery operative in the present invention is chosen such that alone or in a circuit with other batteries is sufficient to drive light emissions from the light source. Batteries operative herein include cylindrical batteries such as AAA, AA, A, metal hydride and lithium containing batteries; cuboidal batteries such as an alkaline 9-volt; and button-type batteries such as lithium containing batteries. Preferably, a button type battery is used. It is appreciated that to drive certain light sources a series circuit of batteries is utilized.

The bezel 42 and base 12 are each independently formed of materials conventional to the art. Preferably, each is formed of an injection moldable thermoplastic material, although it is appreciated that the same are also formable from metals such as aluminum, brass, titanium, and steel. More preferably, the bezel rear surface 44 and front face 24 of the base 12 have comparable hardness values so as to slow wear at the interface therebetween.

An electrical switch 60 upon activation forms an electrical circuit between the light source 54 and the battery 52. The battery case 50 being in electrical contact with one pole 53 of the battery 52 and thereby with the switch 60 upon securement of the battery case 50 to the bezel 42. The opposing battery pole 63 is in electrical contact with a circuit board 66 to which the light source 54 is secured. The switch 60 selectively creates a circuit between the light source 54 and the battery 52 upon engagement. Preferably, a reflector 68 having a light reflective outer surface 70 encompasses at least a portion of the light source 54. A jewel 72 is optionally provided in the illumination light path of an inventive headlamp 10 to create internal reflections therein and thereby create a more uniform illumination field. A crystal 74 is optionally seated within the bezel 42 and serves to protect light assembly internal components from environmental contaminants. In an alternative embodiment, a switch underlies the crystal such that depressing the crystal relative to the base selectively forms an illumination producing circuit. The details of such a switch are found, for example, in U.S. Pat. No. 4,336,574, which is incorporated herein by reference. Preferably, access to light assembly internal components is by way of a threaded cap 78 engaging the rear face 80 of the battery case 50.

The light assembly 40 rotates relative to the base 12 through the use of conventional structures allowing rotation. The inventive embodiment depicted in FIG. 2 shows a circumferential race 84 that allows the flange 51 of the battery case 50 to rotate relative to the base 12, it is appreciated that other structures such as an axial pivot pin rotatably interconnecting a light assembly and a base are also operative herein. An axial pivot pin is shown in a canting arrangement in, for example, U.S. Pat. No. 5,590,416 which is incorporated herein by reference.

The drawings and specification collectively disclose a typical preferred embodiment of the invention. There is no intent to limit the invention by such disclosure, but rather to encompass modifications and alternate constructions apparent to one skilled in the art upon reading of the specification. The scope of the invention is intended to be defined by the appended claims.

What is claimed is:

1. A headlamp comprising:

a base having a first surface adapted to bear against a user's forehead and defining a first plane and a first normal line to the first plane;

a front face inclined downward relative to said first surface by a first angle;

a light assembly including:

a bezel having a rear surface rotatably supported relative to the front face of the base and a front surface inclined relative to said rear surface by a second angle;

a battery case attached to said bezel and defining a closed volume between the battery case and the bezel;

a battery located within said volume;

a generally circular reflector disposed at least in part within said volume;

a plurality of light emitters received in said reflector, said emitters adapted when energized to project a beam of light through the front surface of the bezel with the reflector internally reflecting light from the light sources to create a more uniform illumination field; and a switch connected between said battery and said light emitter;

whereby rotation of the bezel relative to said base rotates the beam of light from a direction parallel to the normal line to a downward direction inclined relative to the normal line by the first angle plus the second angle.

2. The headlamp of claim 1 wherein said base is hollow and is adapted to receive a portion of said light assembly therein.

3. The headlamp of claim 1 wherein said base further comprises a fastener for securing said headlamp to a headband or a helmet.

4. The headlamp of claim 1 further comprising a crystal in contact with said bezel.

5. The headlamp of claim 1 wherein said light emitters are light emitting diodes.

6. The headlamp of claim 1 wherein said battery case has a removable cap affording access to the enclosed volume.

7. The headlamp of claim 1 wherein said light assembly rotates about an axial pin interconnecting said base and said battery case.

8. The headlamp of claim 1 wherein the rotation angle is between 130° and 230°.

9. The headlamp of claim 1 in which the reflector includes a centrally located jewel.

10. The headlamp of claim 1 wherein said light assembly rotates about a race incorporated into said base.

11. The headlamp of claim 10 wherein a circumferential flange of said battery case engages said race.

* * * * *